United States Patent [19]

Wallschlaeger et al.

[11] Patent Number: 4,493,258

[45] Date of Patent: Jan. 15, 1985

[54] INTERFACING CAM AND TOGGLE LOCKUP

[75] Inventors: Alan R. Wallschlaeger, Marion; John F. Wade, Cedar Rapids, both of Iowa

[73] Assignee: Rockwell International Corporation, Pittsburgh, Pa.

[21] Appl. No.: 551,526

[22] Filed: Nov. 14, 1983

[51] Int. Cl.[3] ..... B41F 27/12

[52] U.S. Cl. ..... 101/415.1

[58] Field of Search ..... 101/415.1; 51/364, 367, 51/368, 370, 371, 382, 384, 385, 386

[56] References Cited

U.S. PATENT DOCUMENTS 3,757,691 9/1973 Etchell et al. ..... 101/415.1

4,347,788 9/1982 DuFour et al. ..... 101/415.1

FOREIGN PATENT DOCUMENTS 1246764 9/1967 Fed. Rep. of Germany ... 101/415.1

2092069 8/1982 United Kingdom ..... 101/415.1

*Primary Examiner*—Edgar S. Burr

*Assistant Examiner*—Charles A. Pearson

[57] ABSTRACT

An improved plate lockup mechanism for holding printing plates on a grooved plate cylinder, the mechanism having an elongated cam with an arcuate surface, a bar-like toggle including arcuate lower surfaces that mate with the surface of the cam and a securing member carried on the toggle for engaging the end of a plate and holding it in operative position.

3 Claims, 2 Drawing Figures

INTERFACING CAM AND TOGGLE LOCKUP

BACKGROUND OF THE INVENTION

Field of the Invention

Printing on a continuous web in an offset web press is normally performed by use of a thin, flexible plate whose printing surface has been subjected to ink and to water. The plate roll is manufactured with a slot that extends across its entire length to receive a lockup mechanism for holding the flexible plate tightly against the outer surface of the plate roll. In the usual situation, the plate has inwardly turned tabs or flanges on each end thereof, the flange on one end engaging directly the edge formed by the slot and the flange on the other end being engaged by the lockup mechanism to pull the plate tight. In other instances, provision may be made for the lockup mechanism to engage both ends of the plate to hold it in position.

In manufacturing plate rolls and plate lockups, it is desired to keep the width of the slot gap as narrow as possible to reduce vibration or bouncing resulting from impact of the edges of the slotted area with the cooperating adjoining blanket roll. However, when narrow gaps are used, it has heretofore been necessary to remove the plate roll bearer rings to change lockup parts. Removal of lockup parts without partial disassembly of the plate roll support system has been confined to rolls having comparatively wide gaps.

SUMMARY OF THE INVENTION

A principal object of this invention is to provide a narrow gap plate lockup mechanism which can be removed from the plate roll without the necessity of disassembling the roll from the supporting structure.

An additional object of the invention is to provide an improved plate roll lockup mechanism having a toggle and cam mechanism which can be inserted and removed from a narrow plate roll gap while the roll is in its usual operative position.

BRIEF DESCRIPTION OF THE DRAWINGS

Other objects and advantages of this invention will be in part obvious and in part explained by reference to the accompanying specification and drawings, in which.

Figure 1:
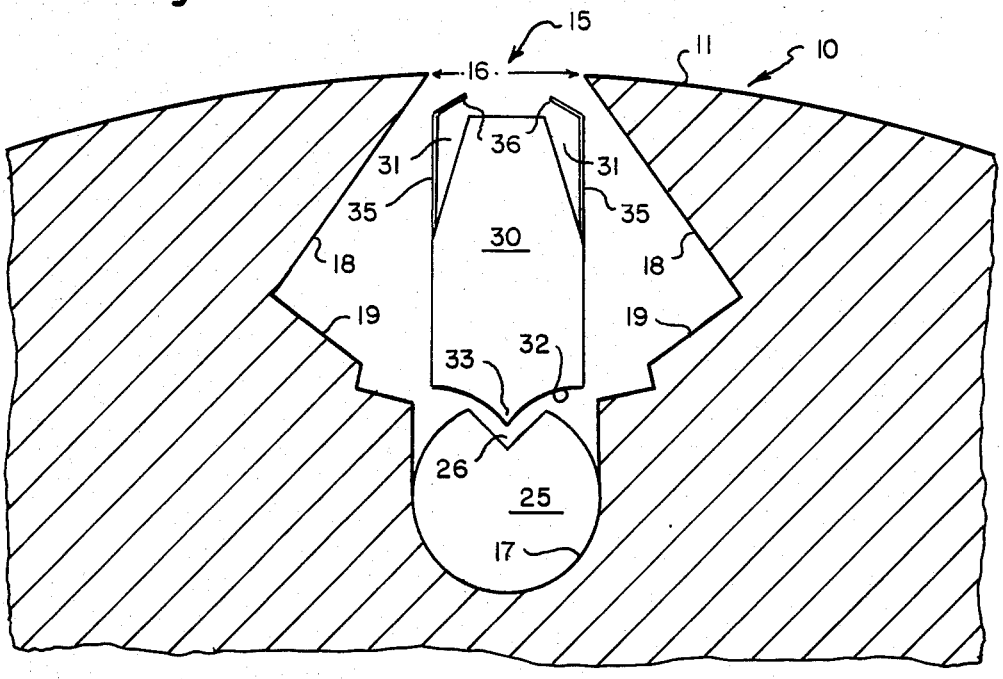
FIG. 1 is a partially sectioned view of a portion of a plate cylinder showing the improved plate lockup mechanism in its released position.
Figure 2:
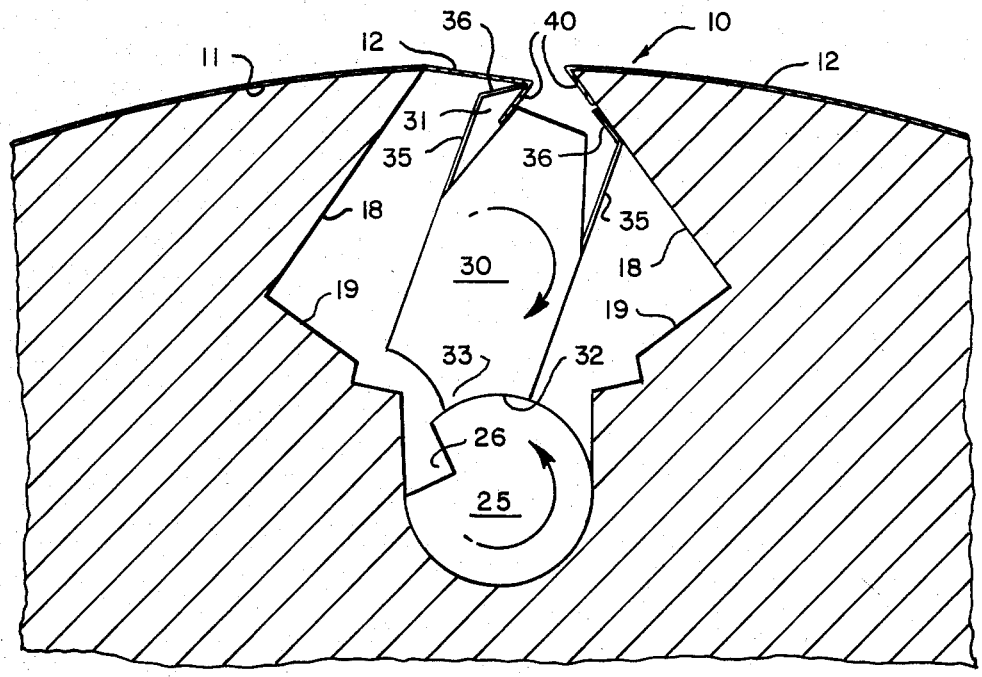
FIG. 2 is a view similar to FIG. 1 showing the lockup mechanism in its engaged position.

For a better understanding of the present invention, reference is made to the drawings, and specifically to FIG. 1, in which the numeral 10 indicates a sectional broken out piece of a printing press plate roll. Plate roll 10 has an outer surface 11 on which a flexible plate 12 (see FIG. 2) is adapted to be mounted. Plate roll 10 is formed with a longitudinal groove 15 that extends across the entire width of roll 10 and which has a gap 16 of relatively narrow proportion, for example, ½ inch. The groove 15 has a bottom surface 17 that is in form providing a circular radius of curvature. The sidewalls of groove 15 are defined by upper portions 18 that extend inwardly from the roll surface and outwardly with respect to each other and a lower portion 19 that generally extends inwardly of the roll and inwardly with respect to each other. By configuring the walls in this fashion, a large volume is provided within the roll which is significantly wider than the gap 16 so that the lockup mechanism can have the necessary room for arcuate movement when locking on a plate 12.

Referring once again to the drawings, it will be seen that the bottom surface 17 receives a elongated cam 25 that has a radius of curvature corresponding to that of the radius of curvature of bottom 17 so that it is free to rotate. Cam 25 is provided with a generally V-shaped removed portion indicated generally by the numeral 26.

Mounted within the cavity defined by walls 17, 18 and 19 is a toggle 30 that is substantially rectangular in cross section except that portions of the upper end have been relieved as indicated at 31 to provide the room necessary to effect plate lockup. Further, the bottom surfaces 32 on said toggle are arcuately shaped and have a radius of curvature which permits mating with the outer surface of cam 25. It can be seen that the two surfaces 32 converge to define an edge 33 that is located substantially at the midpoint of the thickness of toggle 30. Mounted on toggle 30 is a U-shaped spring 35, the upper ends 36 of which are angled in toward each other. This angling of the U-shaped spring provides for necessary engagement with the plate to hold it in locking position.

Referring again to FIG. 2, it will be seen that plate 12 has tangs 40 formed on each end. When a plate is to be mounted, one of the tangs 40 will engage one of the plate edges defining the gap 16 while the other tang is engaged by the flange 36 on spring member 35.

When it is desired to place a plate locking mechanism within the cavity 15 of plate roll 10, the cam 25 is turned so that the removed portion 26 will lie over one of the edges forming the gap 16 and the cam can then be rotated so that it clears the gap and can be inserted into cooperative relationship with lower wall 17. It should be noted that the diameter of the cam 25 exceeds the width of gap 16 to provide the maximum torque arm possible in tightening the plate. After insertion of cam 25, the toggle 30 is inserted downwardly through the gap 16 and held in position in FIG. 1 by means of centering springs. The centering springs are not shown since they are common to the industry and will be well known by those experienced in the art. Once the toggle 30 is inserted into the position shown in FIG. 1, the cam 25 can then be rotated and the toggle will be forced in one direction or the other to assume, for example, the lockup position shown in FIG. 2. As indicated there, counterclockwise movement of cam 25 causes clockwise rotation of the toggle 30 and thereby drawing the lefthand tang 36 of spring 35 into engagement with tab 40 of plate 12 to secure the plate to the outer surface of roll 10.

What is claimed is:

1. A plate clamping arrangement for a reversible printing cylinder comprising in combination: A plate roll for receiving a flexible printing plate having mounting tangs on each end thereof, said roll having a longitudinal groove formed thereof; a bottom surface in said groove having a circular radius of curvature; sidewalls in said groove defining a volume greater than the volume defined by said bottom surface; a circular cam situated within said plate roll groove, said circular cam having an arcuate surface with a radius of curvature substantially equal to the radius of curvature of said bottom surface, said arcuate surface mating with said bottom surface, said cam having a groove running along the length thereof; a bar-like toggle situated within the groove of said plate roll, said bar-like toggle having a pair of lower surfaces that mate with the arcuate surface of said cam; and a generally U-shaped spring mounted on said toggle having upper free ends for engaging a plate to hold it in position on said roll.

2. A plate clamping arrangement as defined in claim 1 wherein said pair of lower surfaces on said toggle converge to define an edge that is located at the midpoint of the thickness of said toggle.

3. A plate clamping arrangement as defined in claim 1 wherein the end of said toggle nearest to the free upper ends of said U-shaped spring is relieved.

* * * * *